US005522914A

United States Patent [19]

Stasko et al.

[11] Patent Number: 5,522,914

[45] Date of Patent: Jun. 4, 1996

[54] SULFUR-CONTAINING POWDER-METALLURGY TOOL STEEL ARTICLE

[75] Inventors: William Stasko, West Homestead; Kenneth E. Pinnow, Pittsburgh, both of Pa.

[73] Assignee: Crucible Materials Corporation, Syracuse, N.Y.

[21] Appl. No.: 384,548

[22] Filed: Feb. 7, 1995

Related U.S. Application Data

[63] Continuation-in-part of Ser. No. 126,562, Sep. 27, 1993, abandoned.

[51] Int. Cl.[6] ..... C22C 33/02

[52] U.S. Cl. ..... 75/231; 75/243; 75/244; 75/246; 419/11; 419/28; 419/29; 419/10

[58] Field of Search ..... 75/231, 243, 244, 75/246; 419/10, 11, 14, 28, 29, 49, 54

[56] References Cited

U.S. PATENT DOCUMENTS

| | | | |
|---|---|---|---|
| 3,598,567 | 8/1971 | Grant . | |
| 4,052,230 | 10/1977 | Aylward | 148/2 |
| 4,121,930 | 10/1978 | Yukawa et al. | 75/238 |
| 4,140,527 | 2/1979 | Kawai et al. | 75/244 |
| 4,160,066 | 7/1979 | Szumachowski et al. | 428/683 |
| 4,249,945 | 2/1981 | Haswell et al. | 75/241 |
| 4,699,657 | 10/1987 | DiGiambattista | 75/228 |
| 4,780,139 | 10/1988 | Hillman et al. | 75/240 |

FOREIGN PATENT DOCUMENTS

| | | |
|---|---|---|
| 0183666A1 | 6/1986 | European Pat. Off. . |
| 0515018A1 | 11/1992 | European Pat. Off. . |
| 4040030A1 | 12/1990 | Germany . |

OTHER PUBLICATIONS

Pinnow et al., "P/M Tool Steels" Metals Handbook, vol. 1, 10th Ed.: Properties and Selection (1989).

Cocks, D. J., "Longer Die Life from H13 Die Casting Dies by the Practical Application of Recent Research Results" ADCI TechData No. 01–88– 01D (1988).

Wallace et al., "Influence of Cooling Rate on the Microstructure and Toughness of Premium H–13 Die Steels" 15th Die Casting Congress & Exposition, Oct. 16–19, 1989, St. Louis, MO, Paper No. G–T89–013.

Dorsch et al., "The Effects of DCM on the Surface of Hardened H–13 Die Components" 15th Die Casting Congress & Exposition, Oct. 16–19, 1989, St. Louis, MO, Paper No. G–T89–031.

Du et al., "The Effects of Sulfur Content on the Performance of H–13 Steel" Die Casting Research Foundation, Inc., Techdata Digest No. 01–83–01D.

Alan Lawley, "Atomization," Metal Powder Industries Federation, Princeton, New Jersey, pp. 21–26 and 59–61 (1992).

G. Hoyle, "High Speed Steels," Butterworths, London, pp. 36–39 (1988).

Johannisson et al., "Horizontal Gas Atomization of Steel Powder," Modern Developments in Powder Metallurty, vol. 12, pp. 131–139 (1981).

"ASP Steel," Stora Kopparberg, Special Steels Division, S–810, 60 Soderfors, Sweden, p. 4 (1973).

Randall German, "Powder Metallurgy Science," Metal Powder Industries Federation, Princeton, New Jersey, pp. 76 and 88 (1984).

*Primary Examiner*—Ngoclan Mai

*Attorney, Agent, or Firm*—Finnegan, Henderson, Farabow, Garrett & Dunner

[57] ABSTRACT

A powder-metallurgy produced tool steel article of a hot worked, fully dense, consolidated mass of prealloyed particles of a tool steel alloy having a sulfur content within the range of 0.10 to 0.30 weight percent and a maximum sulfide size below about 15 microns.

18 Claims, 4 Drawing Sheets

500X 20 μm
STEEL 92-17 (0.005 S)

500X 20 μm
STEEL 92-18 (0.05 S)

500X 20 μm
STEEL 92-19 (0.14 S)

500X 20 μm
STEEL 92-20 (0.26 S)

500 X 20 μm
STEEL 92-79 (0.23% S)
60.5% HOT REDUCTION

500 X 20 μm
STEEL 92-77 (0.22% S)
85% HOT REDUCTION 500X 20 μm

STEEL 92-72 (0.23% S)
95% HOT REDUCTION

SULFUR-CONTAINING POWDER-METALLURGY TOOL STEEL ARTICLE

CONTINUING APPLICATION INFORMATION

This application is a continuation-in-part of U.S. Ser. No. 08/126,562, filed Sep. 27, 1993 now abandoned.

BACKGROUND OF THE INVENTION

1. Field of the Invention

This invention relates to a tool steel article made of a hot worked powder metallurgy tool steel having higher than conventional sulfur content and a method for producing the same.

2. Description of the Prior Art

Tool steels are used conventionally in the manufacture of tooling articles employed in both cutting and noncutting tooling applications. This includes the manufacture of broaches and hobs, as well as of rolls, punches and mold components. In these tooling applications, it is necessary that the tool steel have sufficient strength, toughness, and wear resistance to withstand the service conditions encountered in these typical applications. In addition, they must have adequate machinability and grindability to facilitate production of the desired tooling components.

It is known that the presence of sulfur in tool steels improves their machinability and grindability by forming sulfides that act as a lubricant between the cutting tools used to form the tool component and the chips removed from the steel during this operation. The sulfides also promote chip breaking during the cutting operation incident to tool manufacture to thereby further facilitate this operation.

The use of sulfur in amounts over about 0.10% is known to reduce the hot workability of conventional ingot-cast tool steels and adversely affect their mechanical properties, particularly their toughness. In conventional high sulfur containing tool steels, the sulfides are typically larger and elongated in the direction of hot working. Likewise, with conventional wrought tool steels, the primary carbides in the steel are strung out during hot working to form carbide stringers in the direction or working. The carbide stringers in these steels adversely affect mechanical properties, and their negative effects are so pronounced that they generally overshadow any adverse effects of the sulfides in this regard.

On the other hand, during the manufacture of high sulfur containing tool steel articles by a powder metallurgy practice wherein prealloyed particles of the steel are consolidated to achieve a fully dense article, the carbides are relatively small and well distributed compared to those in conventional tool steels. Because of the favorable size and distribution of the carbides achieved in these tool steels, the adverse effects of the carbide stringers encountered in conventional wrought steel are avoided. The properties of the powder metallurgy produced tool steels are therefore more sensitive to changes in sulfur content and to the size and distribution of the sulfides introduced for the purpose of improving their machinability or grindability. For this reason, sulfur in amounts greater than about 0.07%, are generally not used in powder metallurgy produced tool steels because of the adverse effects of the sulfides on their mechanical properties, for example, as indicated by a decrease in the bend fracture strength of the steel. Powder metallurgy tool steel articles with higher sulfur contents would be more widely used, if the detrimental effects of sulfur on their mechanical properties could be avoided.

SUMMARY OF THE INVENTION

It is accordingly a primary object of the present invention to provide a tool steel article produced from a hot worked powder metallurgy produced high sulfur tool steel wherein the presence of sulfur and resulting sulfides does not significantly adversely affect the mechanical properties while providing the beneficial effect of improved machinability and grindability.

A more specific object of the invention is to provide a tool steel article made from a hot worked high sulfur containing powder metallurgy produced tool steel wherein the presence of sulfur and resulting sulfides does not significantly degrade toughness, as exhibited by the bend fracture strength.

Broadly, in accordance with the invention, there is provided a machinable powder-metallurgy produced sulfur-containing tool steel article comprising a hot worked, fully dense, consolidated mass of nitrogen-gas atomized, prealloyed particles of a tool steel alloy having a sulfur content of 0.10 to 0.30 weight percent; or 0.10 to 0.50, 0.60, or 0.70 weight percent; or0.16 or 0.25% to 0.30, 0.50, 0.60, or 0.70 weight percent, with a maximum sulfide size below about 15 microns.

The tool steel alloy of the hot worked article may have a composition of a wrought high speed tool steel or of a wrought cold work tool steel to which sulfur has been intentionally added within a range of 0.10 to 0.30 weight percent. Broadly, the tool steel of the hot worked article may have in weight;percent 0.80 to 3.00 carbon; 0.20 to 2.00 manganese; 0.10 to0.30 sulfur, or 0.10 to 0.50, 0.60, or 0.70 sulfur, or 0.16 or 0.25% to 0.30, 0.50, 0.60 or 0.70 sulfur; up to 0.04 phosphorus; 0.20 to 1.50 silicon; 3.00 to 12.00 chromium; 0.25 to 10.00 vanadium; up to 11.00 molybdenum; up to 18.00 tungsten; up to 10.00 cobalt; up to 0.10 nitrogen; up to 0.025 oxygen; and balance iron and incidental impurities. Tungsten may be substituted for molybdenum in the stoichiometric ratio of 2:1.

The machinable powder-metallurgy produced sulfur-containing tool steel article may have a minimum transverse bend fracture strength of 500 ksi when heat treated to a hardness of 64 to 66 HRC. The article comprises a hot-worked, fully dense, consolidated mass of nitrogen gas atomized, prealloyed particles of a tool steel alloy of, in weight percent, 1.25 to 1.50 carbon; 0.20 to 1.00 manganese; 0.10 to 0.26 sulfur, or 0.10 to 0.50, 0.60, or 0.70 sulfur, or 0.16 or 0.25% to 0.30, 0.50, 0.60, or 0.70 sulfur; up to 0.04 phosphorous; up to 1.00 silicon; 3.0 to 6.0 chromium; 4.0 to 6.0 molybdenum; 3.50 to 4.50 vanadium; 4.0 to 6.5 tungsten; up to 0.025 oxygen; up to 0.10 nitrogen; and balance iron and incidental impurities. The article has a maximum sulfide size below about 15 microns.

Preferably, the sulfur content of the articles in accordance with the invention may be within the range of 0.14 to 0.26%.

The invention includes a method for manufacturing a powder-metallurgysulfur-containing tool steel article of a hot worked, fully dense, consolidated mass of nitrogen atomized, prealloyed particles of a tool steel alloy having a sulfur content of 0.10 to 0.30 weight percent; or 0.10 to 0.50, 0.60, or 0.70 weight percent; or 0.16 or 0.25% to 0.30, 0.50, 0.60, or 0.70 weight percent; with a maximum sulfide size of about 15 microns. In accordance with the method, prealloyed particles are produced by nitrogen gas atomization and are hot isostatically compacted to full density at a temperature of 2165° F. and a pressure of 15 ksi. The resulting compact is hot worked to a desired article shape at a temperature of 2050° F. and the article is then annealed.

The method in the invention may also be applied to prealloyed particles of a tool steel alloy of the composition, in weight percent, 0.80 to 3.00 carbon; 0.20 to 2.00 manganese; 0.10 to 0.30 sulfur, or 0.10 to 0.50, 0.60, or 0.70 sulfur, or 0.16 or 0.25% to 0.30, 0.50, 0.60, or 0.70 sulfur; up to 0.04 phosphorous; 0.20 to 1.50 silicon; 3.0 to 12.0 chromium; 0.25 to 10.0 vanadium; up to 11.0 molybdenum; up to 18.0 tungsten; up to 10.0 cobalt; up to 0.10 nitrogen; up to 0.025 oxygen; balance iron and incidental impurities.

The method of the invention may likewise be used with prealloyed particles of a tool steel alloy of the composition, in weight percent, 1.25 to 1.50 carbon; 0.20 to 1.00 manganese; 0.10 to 0.26 sulfur, or 0.10 to 0.50, 0.60, or 0.70 sulfur, or 0.16 or 0.25% to 0.30, 0.50, 0.60, or 0.70 sulfur; up to 0.04 phosphorous; up to 1.00 silicon; 3.0 to 6.0 chromium; 4.0 to 6.0 molybdenum; 3.50 to 4.50 vanadium; 4.0 to 6.5 tungsten; up to 0.025 oxygen; up to 0.10 nitrogen; balance iron and incidental impurities.

Preferably, the sulfur content may be within the range of 0.14 to 0.26 weight percent.

In accordance with the invention, the carbon present in the alloy combines with chromium, vanadium, molybdenum and tungsten to form the desired dispersion of wear resistant carbides and to promote secondary hardening. Sufficient carbon is also present to provide for strengthening of the matrix of the steel. The sulfur present in the steel combines primarily with the manganese to produce manganese sulfides or manganese-rich sulfides which facilitate the machinability and grindability of the steel.

To achieve the properties needed in the powder metallurgy produced tool steel articles of this invention, it is essential that the high sulfur powder metallurgy produced tool steels used in their construction be hot worked after consolidation to achieve the high mechanical strength needed for tooling components. It is also essential that the production and processing conditions for the powder metallurgy produced tool steels used in the articles of this invention be controlled so that the sizes and distribution of the sulfides introduced by the sulfur additions do not significantly degrade mechanical properties. In the powder metallurgy produced tool steel used in the tool steel articles of this invention, this is achieved by maintaining the maximum size of the sulfides below about 15 μm in their longest dimension.

DETAILED DESCRIPTION OF THE PREFERRED EMBODIMENTS

Figure 1A:
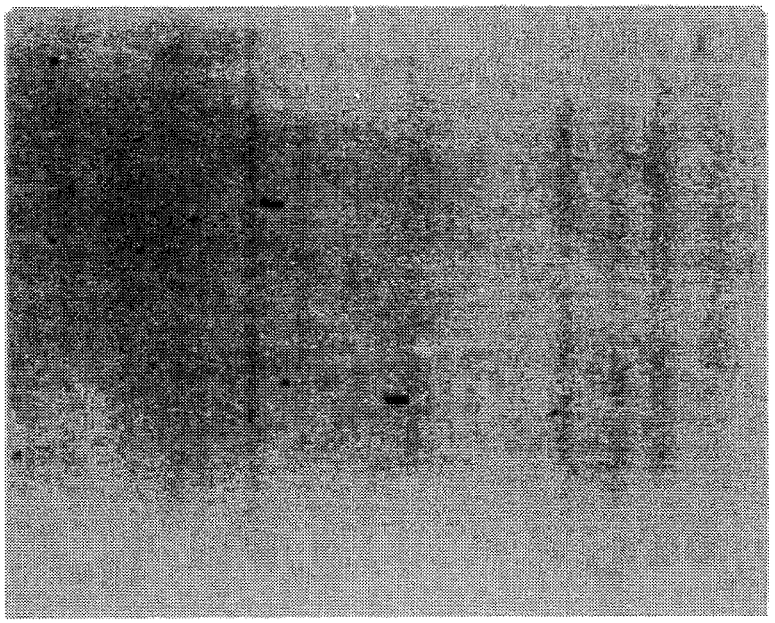
Figure 1B:
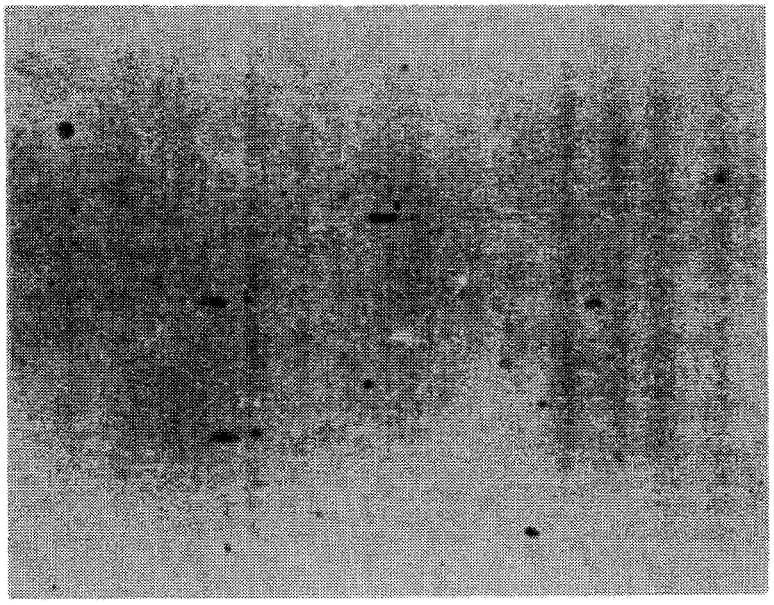
Figure 1C:
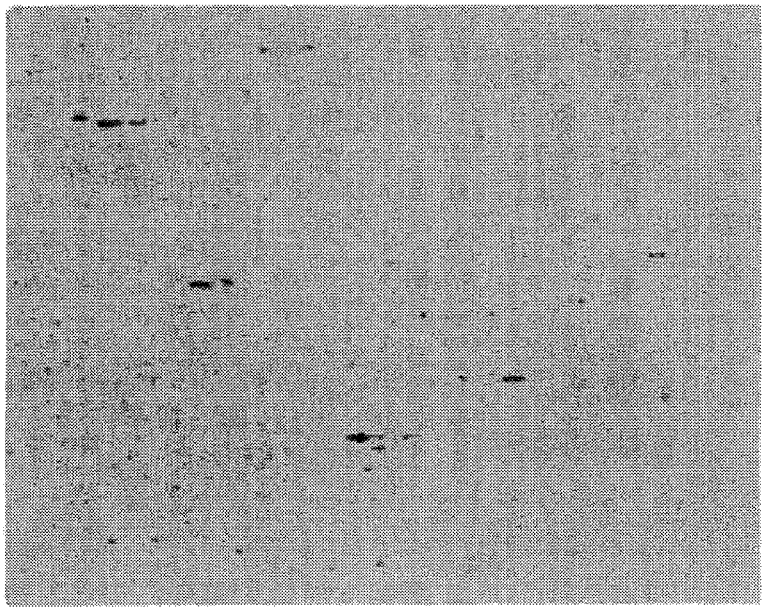
Figure 1D:
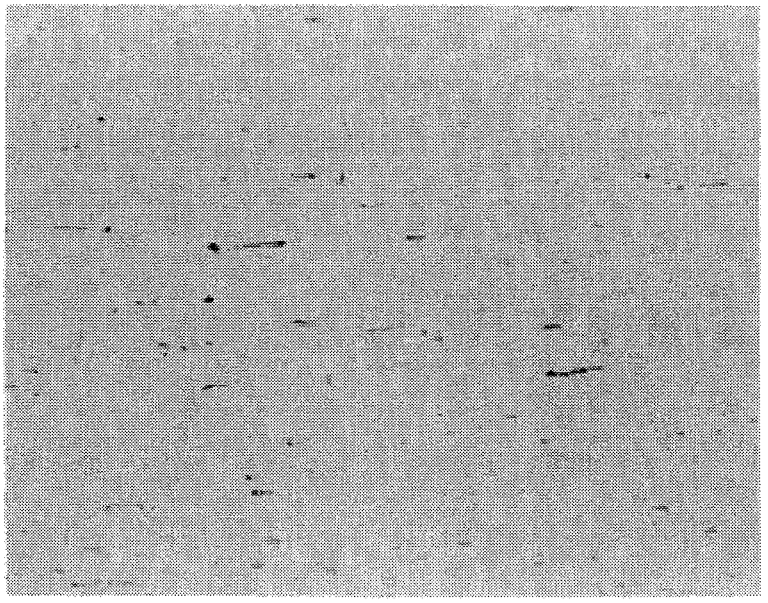

By way of demonstration of the invention, a series of experimental tool steels were made with varying sulfur contents and subjected to various mechanical property and machinability tests. Samples of several commercial powder metallurgy produced high speed tool steels were also subjected to the same tests for comparison. Except for sulfur content, the commercial powder metallurgy tool steels generally have the same nominal composition as the experimental tool steels. The actual chemical compositions of the experimental tool steels and of the commercially produced tool steels are given in Tables I and II.

TABLE I

CHEMICAL COMPOSITION OF EXPERIMENTAL POWDER METALLURGY TOOL STEELS

| Bar Number | Heat Number | C | Mn | P | S | Si | Ni | Cr | V | W | Mo | Al | N | O |
|---|---|---|---|---|---|---|---|---|---|---|---|---|---|---|
| 92-17 | 518-662 | 1.42 | 0.30 | 0.007 | 0.004 | 0.51 | — | 3.89 | 4.04 | 5.66 | 5.28 | 0.02 | 0.034 | 0.006 |
| 92-18 | 518-658 | 1.45 | 0.34 | 0.006 | 0.05 | 0.54 | — | 5.00 | 3.73 | 5.44 | 4.90 | — | 0.035 | 0.005 |
| 92-19 | 518-659 | 1.42 | 0.46 | — | 0.14 | 0.54 | — | 3.86 | 3.80 | 5.49 | 4.90 | — | 0.027 | 0.006 |
| 92-20 | 518-63 | 1.39 | 0.64 | 0.005 | 0.26 | 0.57 | — | 3.86 | 3.97 | 5.79 | 5.05 | — | 0.028 | 0.013 |

TABLE II

CHEMICAL COMPOSITION OF COMMERCIAL HIGH SULFUR TOOL STEELS

| Bar Number | C | Mn | P | S | Si | Ni | Cr | V | W | Mo | Co | N | O |
|---|---|---|---|---|---|---|---|---|---|---|---|---|---|
| 92-79 | 1.41 | 0.69 | 0.022 | 0.230 | 0.52 | 0.20 | 3.88 | 3.98 | 5.41 | 5.27 | 0.33 | 0.03 | 0.013 |
| 92-81 | 1.42 | 0.73 | 0.018 | 0.230 | 0.55 | 0.22 | 3.89 | 3.99 | 5.27 | 5.18 | 0.33 | 0.05 | 0.014 |
| 92-77 | 1.41 | 0.74 | 0.022 | 0.220 | 0.54 | 0.16 | 3.89 | 4.01 | 5.41 | 5.13 | 0.34 | 0.05 | 0.014 |
| 92-78 | 1.40 | 0.68 | 0.018 | 0.240 | 0.55 | 0.11 | 3.90 | 3.90 | 5.40 | 5.13 | 0.13 | 0.06 | 0.018 |
| 92-78 | 1.45 | 0.67 | 0.016 | 0.230 | 0.54 | 0.17 | 3.87 | 3.87 | 5.42 | 5.15 | 0.27 | 0.05 | 0.016 |
| 92-74 | 1.41 | 0.65 | 0.022 | 0.210 | 0.55 | 0.17 | 3.89 | 3.94 | 5.46 | 5.14 | 0.26 | 0.04 | 0.012 |

The production conditions for the experimental tool steels were designed to minimize the size of the sulfides in the microstructure. They were produced from nitrogen gas atomized prealloyed powders produced from 300-pound induction melted heats. About 200 pounds of powder from each heat were screened to −16 mesh (U.S. Standard) and loaded into 8-inch diameter, low carbon steel containers which were hot outgassed at 400° F. and then sealed by welding. The containers were then heated to 2165° F. and isostatically compacted at this temperature for four hours at a pressure of 15 ksi and then slowly cooled to ambient temperature. The resulting compacts were then heated to a temperature of 2050° F., hot worked to 3-inch diameter bars, and finally annealed using a conventional high speed tool steel annealing cycle.

The commercial powder metallurgy tool steels were produced from −16 mesh nitrogen atomized powders and are representative of materials receiving different amounts of hot reduction after consolidation by hot isostatic pressing. No special measures were used in production of these steels to control sulfide size.

Several tests were conducted to compare the properties of the tool steel articles of the invention to those of articles made from high sulfur containing powder metallurgy tool steels of different manufacture. Tests were made to demonstrate the effects of composition and the methods of manufacture on sulfide size, bend fracture strength, impact strength, and machinability. The machinability tests were conducted on specimens in the fully annealed condition, whereas the bend fracture and impact tests were conducted on specimens in the hardened and tempered condition. The heat treatment for the latter specimens involved austenitizing for four minutes in molten salt at 2200° F., oil quenching to room temperature, and triple tempering in molten salt for 2 hours plus 2 hours plus 2 hours at 1025° F. After this heat treatment, the hardness of the specimens ranged between 64 and 66 Rockwell C.

Figure 2A:
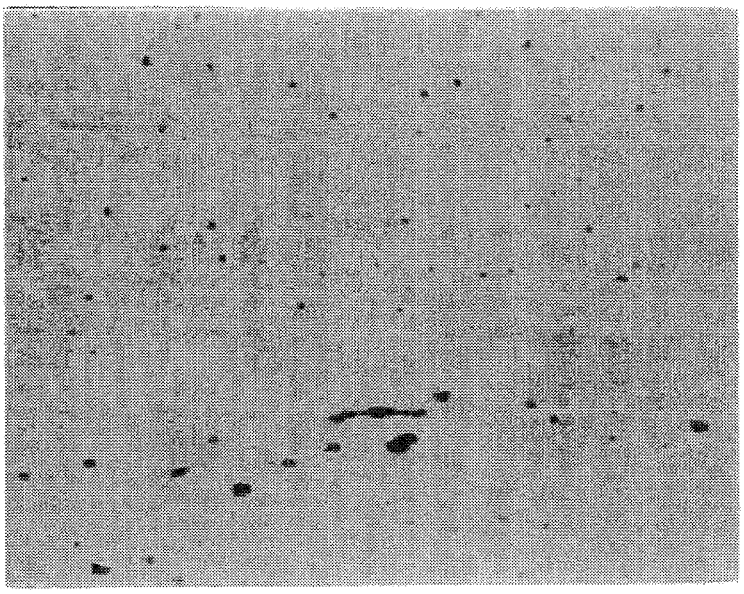
Figure 2B:
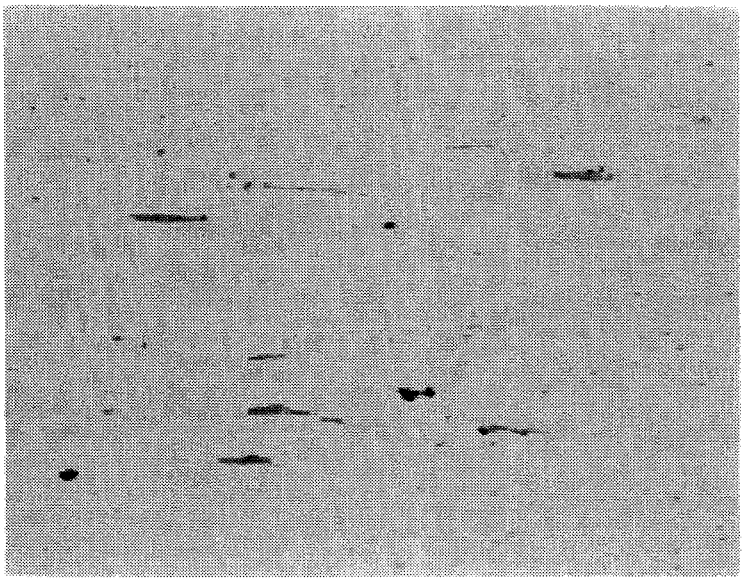
Figure 2C:
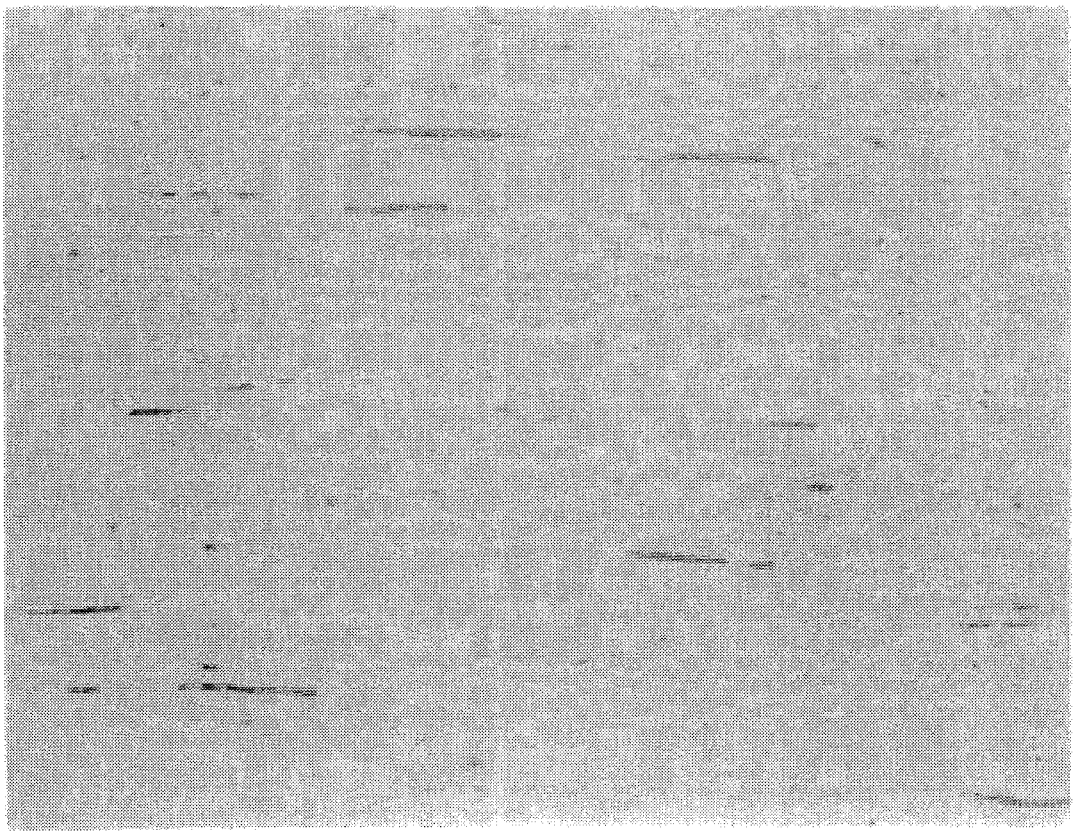

The sizes and distribution of the sulfides in the experimental and commercial tool steels are shown in Figures 1 and 2, respectively. As expected, the number of sulfides in experimental tool steels increase with sulfur content, as can be seen by comparing the microstructures for steels 92-17, 92-18, 92-19 and 92-20 in Figure 1. It is also clear that in accord with this invention all the sulfides in the experimental tool steels, regardless of sulfur content, are less than about 15 μm in their longest dimension. Further, it is clear that the size of the sulfides in the experimental tool steels are considerably smaller in their largest dimensions than the sulfides in the commercial tool steels of similar composition. As shown in Figure 2, the size of the sulfides in these latter steels range from about 20 to 30 μm in length, depending on the amount of hot reduction received in production.

The Charpy C-notch impact properties and bend fracture strengths of the experimental and commercial tool steels are given in Tables III and IV, respectively. Comparison of the results for the experimental tool steels shows that by keeping the maximum sulfide size below 15 μm, it is possible to increase sulfur content for the purpose of improving machinability without sacrificing toughness. This is indicated by the fact that the impact and bend fracture strengths of the experimental steels in both the longitudinal and transverse directions are essentially equivalent for sulfur contents ranging between 0.005 and 0.26%.

TABLE III

IMPACT AND BEND FRACTURE STRENGTHS OF EXPERIMENTAL TOOL STEELS[1]

| Bar | Sulfur | Hot | | C-Notch Impact Strength (ft-lb) | | Bend Fracture Strength (ksi) | | Maximum Sulfide Size |
|---|---|---|---|---|---|---|---|---|
| Code | Content | Reduction | Hardness | Longitudinal | Transverse | Longitudinal | Transverse | microns |
| 92-17 | 0.004 | 85 | 66.5 | 24.0 | 9 | 757 | 517 | 4 |
| 92-18 | 0.05 | 85 | 66.0 | 25.5 | 11.5 | 753 | 507 | 6 |
| 92-19 | 0.14 | 85 | 66.0 | 23.0 | 11 | 739 | 547 | 12 |
| 92-20 | 0.26 | 85 | 65.0 | 24.0 | 11 | 711 | 561 | 15 |

TABLE IV

IMPACT AND BEND FRACTURE STRENGTHS OF COMMERCIAL TOOL STEELS[1]

| Bar | Hot | Hardness | C-Notch Impact Strength (ft-lb) | | Bend Fracture Strength (ksi) | | Maximum Sulfide Size |
|---|---|---|---|---|---|---|---|
| Code | Reduction % | HRC | Longitudinal | Transverse | Longiudinal | Transverse | microns |
| 92-79 | 60.5 | 65.0 | 9.0 | 4.5 | 411 | 369 | 28 |
| 92-81 | 60.5 | 64.5 | 10.0 | 6.0 | 559 | 389 | 20 |
| 92-77 | 85.0 | 65.0 | 18.5 | 5.5 | 672 | 421 | 24 |
| 92-78 | 85.0 | 65.0 | 19.0 | 5.5 | 651 | 383 | 32 |
| 92-72 | 94.0 | 66.0 | — | 7.0 | 655 | 397 | 30 |
| 92-74 | 99.0 | 66.0 | 19.5 | 8.0 | 695 | 427 | 30 |

[1]Austenitized at 2200° F. for 4 minutes, oil quenched, and triple tempered at 1025° F. for 2 plus 2 plus 2 hours.

Comparison of the mechanical properties for the commercial tool steels given in Table IV shows that their impact and bend fracture strengths are generally improved by increasing the amounts of hot reduction, even though it results in some elongation of the sulfides. However, because of the larger size of the sulfides in these steels, their mechanical properties are significantly lower than those of the experimental tool steels having essentially the same composition and amount of hot reduction. Compare, for example, the mechanical properties of Steel 92-20 (0.26% S) which has a maximum sulfide size of about 15 μm and longitudinal and transverse bend fracture strengths of 771 and 561 ksi, respectively, with those of Steel 92-78 (0.24% S) with a maximum sulfide size of about 30 μm and longitudinal and transverse bend fracture strengths of 651 and 383 ksi, respectively.

The results of the drill machinability tests conducted on the experimental tool steels in the annealed condition are given in Table V. The drill machinability indexes in this table were obtained by comparing the times required to drill holes of the same size and depth in these steels and by multiplying the ratios of the times for each steel to that for the experimental steel with 0.005% sulfur by 100. Indexes greater than 100 indicate that the drill machinability of the steel being tested is greater than that of the experimental tool steel article containing 0.005% sulfur (Steel 91-60). The results show that increasing sulfur from 0.005to 0.26% improves machinability of the experimental tool steels and that the greater improvement is achieved at sulfur contents at or above about 0.14%.

TABLE V

EFFECT OF SULFUR CONTENT ON THE DRILL MACHINABILITY OF EXPERIMENTAL TOOL STEELS

| Bar | | Hardness | Drill Machinability Index-MI[1] | |
|---|---|---|---|---|
| Number | % S | HRC | Test Values | Avg. |
| 91-17 | 0.005 | 21 | 100, 100, 100 | 100 |
| 91-18 | 0.05 | 21 | 104, 104, 109 | 106 |
| 91-19 | 0.14 | 22 | 117, 116, 127 | 120 |
| 91-20 | 0.26 | 21 | 140, 134, 150 | 141 |

[1] $$\text{Drill Machinability Index} = \frac{\text{Time to Drill Test Material}}{\text{Time to Drill Reference Standard Material}} \times 100$$

It may be seen from the above that by reducing the size of the sulfides in articles made from hot worked powder metallurgy tool steels, it is possible to substantially negate the negative effects of high sulfur contents on their properties. Hence, with the invention it is possible to produce powder metallurgy tool steel articles with sulfur contents higher than conventionally permitted to achieve improved machinability without: significant degradation of the mechanical properties, particularly as exhibited by the bend fracture strength of the steel.

The term "sulfur containing tool steel article" is restricted to cold work tool steels and high speed tool steels.

What is claimed is:

1. A machinable powder metallurgy produced sulfur containing tool steel article comprising a hot worked, fully dense, consolidated mass of nitrogen gas atomized, prealloyed particles of a tool steel alloy comprising in weight percent 0.80 to 3.00 carbon, 0.20 to 2.00 manganese, 0.10 to 0.30 sulfur, up to 0.04 phosphorus, 0.20 to 1.50 silicon, 3.0 to 12.00 chromium, 0.25 to 10.00 vanadium, up to 11.00 molybdenum, up to 18.00 tungsten, up to 10.00 cobalt, up to 0.10 nitrogen, up to 0.025 oxygen, balance iron and incidental impurities, with a maximum sulfide size below about 15 μm.

2. A machinable powder metallurgy produced sulfur containing tool steel article having a minimum transverse bend fracture strength of 500 ksi when heat treated to a hardness of 64 to 66 HRC, said article comprising a hot worked, fully dense, consolidated mass of nitrogen gas atomized, prealloyed particles of a tool steel alloy consisting essentially of, in weight percent, 1.25 to 1.50 carbon, 0.20 to 1.00 manganese, 0.10 to 0.26 sulfur, up to 0.04 phosphorus, up to 1.00 silicon, 3.0 to 6.0 chromium, 4.0 to 6.0 molybdenum, 3.50 to 4.50 vanadium, 4.0 to 6.5 tungsten, up to 0.025 oxygen, up to 0.10 nitrogen, balance iron and incidental impurities, and said article having a maximum sulfide size below about 15 μm.

3. A powder metallurgy produced sulfur bearing tool steel article of claims 1, or 2 in which the sulfur content is within the range of 0.14 to 0.26 percent.

4. A method for manufacturing a powder metallurgy sulfur containing tool steel article comprising a hot worked, fully dense, consolidated mass of nitrogen atomized, prealloyed particles of a tool steel alloy having a sulfur content of 0.10 to 0.30 weight percent with a maximum sulfide size of about 15 μm; said method comprising producing said prealloyed particles by nitrogen gas atomization, hot isostatically compacting the prealloyed particles to full density at a temperature of 2165° F. and at a pressure of 15 ksi, hot working the resulting compact to a desired shape of the article at a temperature of 2050° F., and annealing said article.

5. A method for manufacturing a powder metallurgy sulfur containing tool steel article, comprising a hot worked fully dense, consolidated mass of nitrogen gas atomized, prealloyed particles of a tool steel alloy comprising, in weight percent, 0.80 to 3.00 carbon, 0.20 to 2.00 manganese, 0.10 to 0.30 sulfur, up to 0.04 phosphorus, 0.20 to 1.50 silicon, 3 to 12.00 chromium, 0.25 to 10.00 vanadium, up to 11.00 molybdenum, up to 18.00 tungsten, up to 10.00 cobalt, up to 0.10 nitrogen, up to 0.025 oxygen, balance iron and incidental impurities and with a maximum sulfide size of 15 μm, said method comprising producing said prealloyed particles by nitrogen gas atomization, hot isostatically compacting the prealloyed particles to full density at a temperature of 2165° F. and a pressure of 15 ksi, hot working the resulting compact to a desired shape of the article at a temperature of 2050° F., and annealing said article.

6. A method for manufacturing a powder metallurgy sulfur containing tool steel article having a minimum transverse bend fracture strength of 500 ksi when heat treated to a hardness of 64 to 66 HRC, said article comprising a hot worked, fully dense, consolidated mass of nitrogen atomized, prealloyed particles of a tool steel alloy consisting essentially of, in weight percent, 1.25 to 1.50 carbon, 0.20 to 1.00 manganese, 0.10 to 0.26 sulfur, up to 0.04 phosphorus, up to 1.00 silicon, 3.0 to 6.0 chromium, 4.0 to 6.0 molybdenum, 3.5 to 4.50 vanadium, 4.0 to 6.5 tungsten, up to 0.025 oxygen, up to 0.10 nitrogen, balance iron and incidental impurities with a maximum sulfide size of about 15 μm, said method producing said prealloyed particles by nitrogen gas atomization, compacting the prealloyed particles to full density at 2165° F., and at a pressure of 15 ksi, hot working the compact to a desired shape of the article at 2050° F. and annealing said article.

7. The method of claims 4, 5 or 6 in which the sulfur content is within the range of 0.14 to 0.26 weight percent.

8. A machinable powder metallurgy produced sulfur containing tool steel article comprising a hot-worked, fully dense, consolidated mass of nitrogen gas atomized, prealloyed particles of a tool steel alloy comprising in weight percent 0.80 to 3.00 carbon, 0.20 to 2.00 manganese, 0.10 to 0.70 sulfur, up to 0.04 phosphorus, 0.20 to 1.50 silicon, 3.0 to 12.00 chromium, 0.25 to 10.00 vanadium, up to 11.00 molybdenum, up to 18.00 tungsten, up to 10.00 cobalt, up to 0.10 nitrogen, up to 0.025 oxygen, balance iron and incidental impurities, with a maximum sulfide size below about 15 μm.

9. The article of claim 8, in which the sulfur content is 0.10 to 0.60.

10. The article of claim 8, in which the sulfur content is 0.10 to 0.50.

11. The article of claim 8, in which the sulfur content is 0.16 to 0.70.

12. The article of claim 8, in which the sulfur content is 0.16 to 0.60.

13. The article of claim 8, in which the sulfur content is 0.16 to 0.50.

14. The article of claim 8, in which the sulfur content 0.16 to 0.30.

15. The article of claim 8, in which the sulfur content is 0.25 to 0.70.

16. The article of claim 8, in which the sulfur content is 0.25 to 0.60.

17. The article of claim 8, in which the sulfur content is 0.25 to 0.50.

18. The article of claim 8, in which the sulfur content is 0.25 to 0.30.

* * * * *